US010060060B2

(12) United States Patent
Elliott et al.

(10) Patent No.: US 10,060,060 B2
(45) Date of Patent: Aug. 28, 2018

(54) STITCHING MODE REGULATOR

(71) Applicant: Gammill, Inc., West Plains, MO (US)

(72) Inventors: Daniel Lee Elliott, West Plains, MO (US); Joseph Wesley Bauman, Cabool, MO (US); John Ray Busé, Houston, MO (US); Bettilou Kenney Langford, Stockton, MO (US)

(73) Assignee: Gammill, Inc., West Plains, MO (US)

( * ) Notice: Subject to any disclaimer, the term of this patent is extended or adjusted under 35 U.S.C. 154(b) by 35 days.

(21) Appl. No.: 14/690,903

(22) Filed: Apr. 20, 2015

(65) Prior Publication Data

US 2015/0299924 A1 Oct. 22, 2015

Related U.S. Application Data

(60) Provisional application No. 61/981,949, filed on Apr. 21, 2014.

(51) Int. Cl.

| | |
|---|---|
| ***G06F 7/66*** | (2006.01) |
| ***D05B 19/00*** | (2006.01) |
| ***D05B 19/12*** | (2006.01) |

(52) U.S. Cl.

CPC ..... *D05B 19/006* (2013.01); *D05B 19/12* (2013.01); *D05D 2205/06* (2013.01)

(58) Field of Classification Search

CPC ..... D05B 19/006; D05B 19/02; D05B 19/08; D05B 19/085; D05B 19/10; D05B 19/105; D05B 19/12; D05B 19/14; D05B 19/16; D05D 2205/06

See application file for complete search history.

(56) References Cited

U.S. PATENT DOCUMENTS

| | | | | |
|---|---|---|---|---|
| 4,292,905 | A * | 10/1981 | Widmer | D05B 19/006 112/470.04 |
| 4,873,931 | A * | 10/1989 | Takagi | D05B 47/04 112/255 |
| 7,552,691 | B1 | 6/2009 | Martell | |
| 7,921,788 | B2 | 4/2011 | Fujihara | |
| 2004/0083022 | A1 | 4/2004 | Akira | |
| 2006/0112866 | A1 | 6/2006 | Pfeifer | |
| 2008/0006192 | A1 * | 1/2008 | Zeiger | D05B 19/006 112/102.5 |
| 2009/0151612 | A1 | 6/2009 | Bentley | |
| 2009/0272304 | A1 | 11/2009 | Watts | |

(Continued)

OTHER PUBLICATIONS

International Search Report and Written Opinion dated Jul. 23, 2015.

*Primary Examiner* — Nathan Durham
(74) *Attorney, Agent, or Firm* — Husch Blackwell LLP

(57) ABSTRACT

The present invention relates to a method of operating a quilting or sewing machine. In the method, an operator may switch the modes in which the sewing machine is operating. The modes may be switched when the sewing machine is in operation or when the machine is stopped. The modes to which the sewing machine may be switched to and from may be pre-set modes as defined by an operator. The modes that may be switched to and from may include settings for stitch mode and stitch speed. The buttons may be physical buttons associated with the sewing machine's handles, or they may be digital buttons associated with a tablet device.

20 Claims, 4 Drawing Sheets

(56) References Cited

U.S. PATENT DOCUMENTS

| | | | | |
|---|---|---|---|---|
| 2011/0000413 | A1* | 1/2011 | Landoni | D05B 1/24<br>112/166 |
| 2011/0083597 | A1* | 4/2011 | Okuyama | D05B 19/12<br>112/470.03 |
| 2013/0190916 | A1 | 7/2013 | Schnaufer | |

* cited by examiner

STITCHING MODE REGULATOR

CROSS-REFERENCE TO RELATED APPLICATION

This application claims priority and benefit of U.S. Provisional Patent Application 61/981,949 filed Apr. 21, 2014 entitled SWITCHING MODES BY HANDLE BUTTON WHILE RUNNING, and is hereby incorporated by reference in its entirety.

BACKGROUND OF INVENTION

The present invention relates to sewing. In particular, the invention relates to particular styles of sewing that incorporate decorative stitching such as quilting. A quilt is a type of blanket typically having three layers: a decorative top layer, a middle layer of insulating material, and a backing layer. "Quilting" refers to the technique of joining these layers by stitches or ties.

Traditional quilting was done by hand and was very labor intensive. The invention of the sewing machine changed that. Quilting evolved from production of functional blankets by specialized artisans into a popular hobby enjoyed by many.

Quilting sewing machines typically have the ability to perform different modes of operation. Normally, these modes include Constant mode, Basting mode, and Regulated mode. The Constant mode operates at a set motor speed, regardless of how the user moves the machine. The Basting mode stitches at a large interval as the machine is moved, typically around 1" between stitches. Regulated mode varies the motor speed continually to maintain a set stitch length, regardless of how fast the user is moving the machine. Switching between these modes is normally performed by choosing a mode with some user interface environment.

Each of the different modes has specific strengths and weaknesses depending on the operation being performed by the user. For instance, it is common for users to utilize Regulated mode when stitching large, sweeping patterns. It is common for users to utilize Constant mode when doing lots of small stitches for "filling" type operations. The normal process has been for the user to stop the machine, manually switch between modes, and then start stitching again in the new mode.

Several years ago, the Coast Regulate mode was developed as a way for the machine to sense and automatically switch between Regulated and Constant modes. In Coast Regulate mode, the machine normally runs in Regulated mode. The machine measures whether the needed motor speed is above a set threshold. If the required motor speed falls below this threshold, then the machine recognizes that the user is slowing down to do "fill" work, etc. and switches to a Constant operation at a user-set speed. If the user speeds up the movement of the machine enough to go back above the threshold, the machine returns to Regulated operation. While this does work, many users find it difficult to correctly set the threshold so that they get the desired results.

SUMMARY OF INVENTION

The present invention relates to a quilting machine, more specifically, to the stitching modes in which the quilting machine operates. In the present invention, the quilting or sewing machine may operate in a number of modes. For example, it may operate in Constant, Basting, or Regulated mode. The present invention includes a control interface, which may be switches including buttons. The preferred embodiment includes two buttons on each of two switches positioned on a handle for controlling the sewing machine. The buttons are programmable to control a specific mode in which the machine should be operating. Thus, when a user presses one of the buttons, the machine operation will change from the current mode to the alternative mode programmed to the pressed button.

A user may press a button or other control interface, and thus switch the mode in which the machine is operated at any time, whether the machine is presently in operation or not. The settings that the buttons communicate to the machine may be hard-coded as pre-set when the machine is sent from the factory, or users may pre-set the settings to desired operating parameters. When the user pre-sets the settings, they may control aspects such as mode, speed, etc.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

The present invention is directed generally toward a method of switching modes of operation of a quilting, or sewing machine. More specifically, it is directed toward a method of switching modes of operation while the sewing machine is running, and wherein the modes of operation have been programmed by a user.

Figure 1:
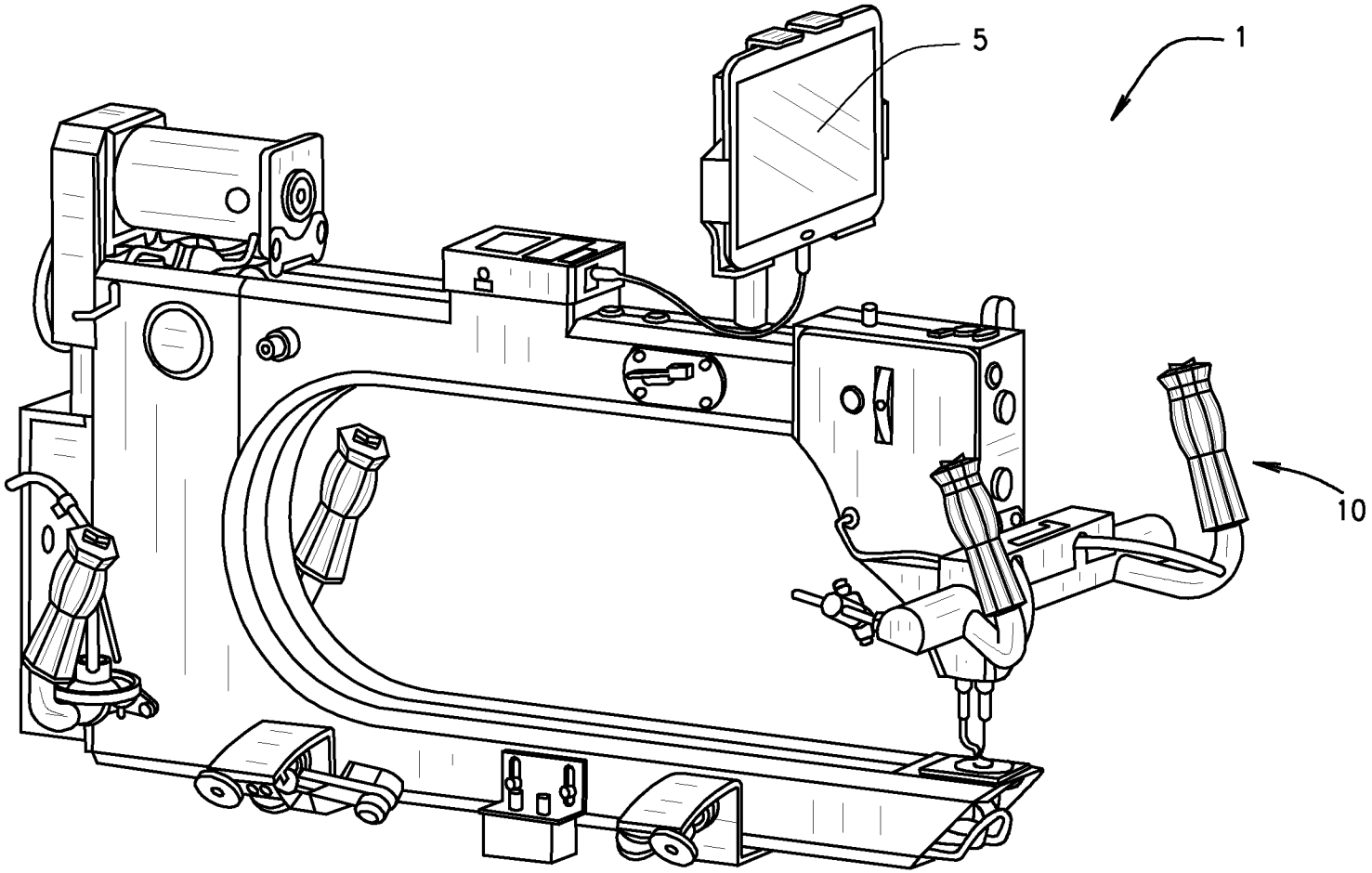
FIG. 1 is a perspective view of a sewing machine having a handle assembly and tablet device.

FIG. 1 provides a perspective view of a sewing machine 1 having each of a tablet 5 for controlling the sewing machine 1 and a handle assembly 10 for operating the sewing machine. The manner in which the tablet 5 and the handle assembly 10 operate the sewing machine 1 is described in greater detail herein below.

Figure 2:
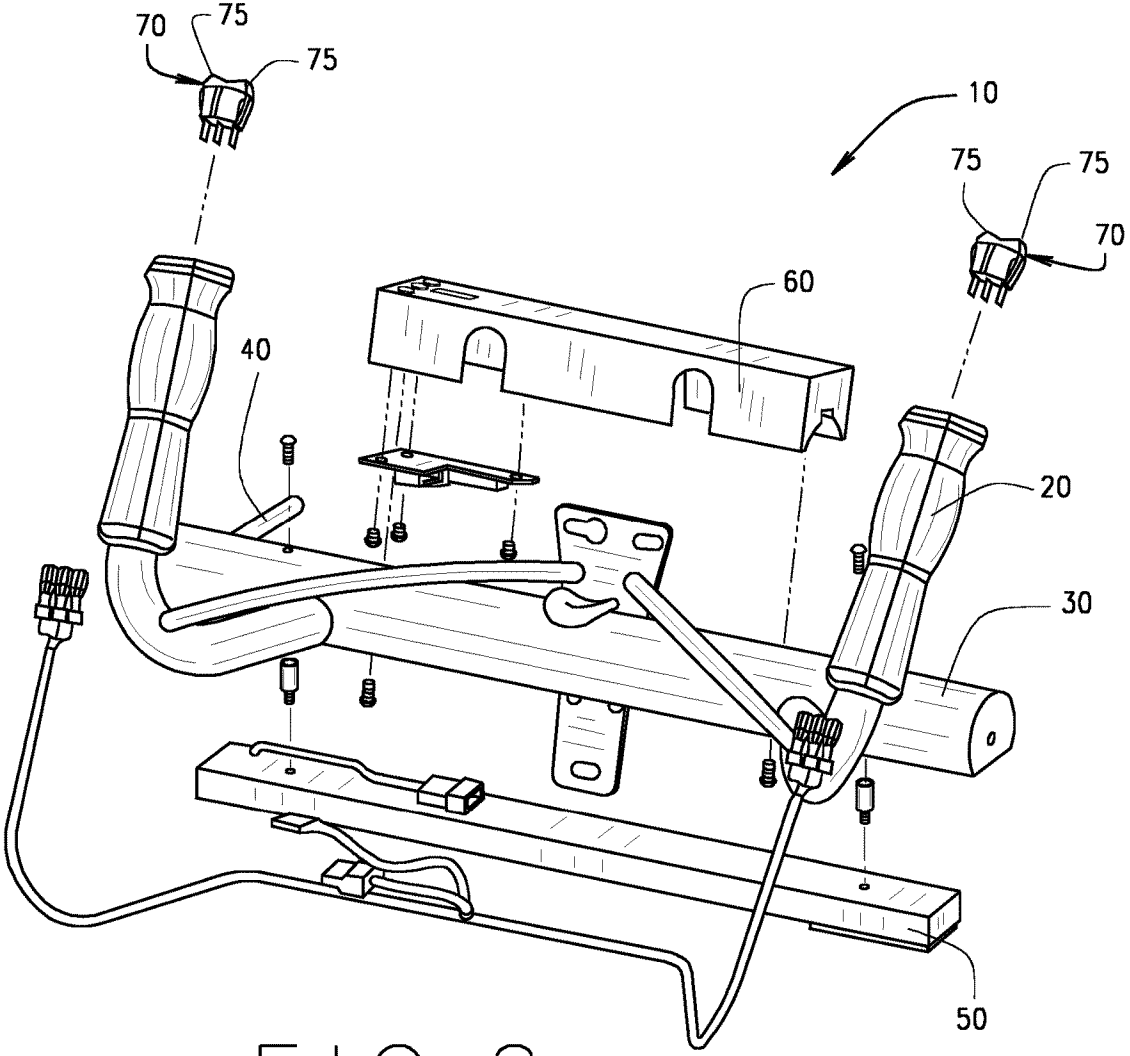
FIG. 2 is an exploded perspective view of handle assembly associated with a sewing machine.

FIG. 2 illustrates an exploded perspective view of the handle assembly 10 for use with a sewing machine (not illustrated). Handle assembly 10 includes components known throughout the art including grips 20 for users to grasp in steering the handle assembly 10, a casing 30 for including operative components therein, a post 40 to which a laser may be mounted, and LED light fixture 50 for illuminating a workspace for a user. In operation, handle assembly 10 operates in a manner known in the art for quilting, both traditional long-armed stitching methods and those including a pantograph pattern, where the pantograph pattern is traced by a laser, physical pointer, or other digital means.

FIG. 2 further illustrates an enclosure member 60, which may be used to contain and secure various electronic, mechanical, and digital components for operating the sewing machine. Those components may be operated by a control interface 70. Control interface 70 is illustrated in FIG. 2 as exploding from grips 20, as switches 70.

Control interface 70 may include a plurality of buttons, or alternatively switches, for controlling various aspects of the sewing machine. Switches 70 are illustrated in FIG. 2 as each including two buttons 75. The means by which buttons 75 of switches 70 adjust the sewing machine features are means known in the art of electronics. For example, switches 70 and buttons 75 may be in electronic communication with a controller that adjusts the motor associated with the sewing machine to adjust stitching mode, speed, etc. (not illustrated).

In the present invention, the settings that buttons 75 communicate to the controller are pre-determined by a user. Alternatively, the settings may be hard-wired and defined with factory settings. In the present embodiment, settings that the user may define include, but are not limited to, stitch speed and stitch mode (e.g. Constant, Basting, Regulated). For example, a user may define that pushing a first button 75 causes the sewing machine to switch to Constant mode at a speed of 20 stitches per inch, or alternatively, pushing a second button 75 causes the sewing machine to switch to Constant mode at a speed of 40 stitches per inch. The aforementioned buttons may be a toggled switch, such as buttons 75 of switch 70, or the buttons may be separate and independent buttons. The means by which a user may define the settings programmed for use with the sewing machine may be any means known throughout the art. For example, the settings may be programmable on a computer, tablet, or mobile device, which may then be transferred to buttons 75 via a manner known in the art, for example a USB, Wi-Fi, Bluetooth, or other connection. Alternatively there may be a control panel located elsewhere on the sewing machine for adjusting the settings associated with control interface 70. When a user pushes a button 75 of switch 70 associated with particular settings, those settings may be implemented immediately. It should be noted that the settings may be implemented immediately, without the need to stop the machine. Thus, the settings may be implemented while the machine is operating or stopped.

In the illustrated embodiment, buttons 75 for adjusting settings associated with the sewing machine are embodied as switches 70, wherein each switch 70 includes two buttons 75. In other foreseeable embodiments, the buttons 75 of switches 70, or other control interface, may be located elsewhere on handle assembly 10, for example casing 30. The control interface may be placed at any location so long as it is within reach of a user. The control interface 70, such as switches 70 with buttons 75 may alternatively be located at a rear set of handles associated with a rear portion of a quilting machine that is well-known in the art for being used in tracing pantograph patterns. The preferred embodiment includes two toggle switches 70, made up of four buttons 75 (two buttons 75 for each switch 70), for controlling sewing modes. However, embodiments are further envisioned wherein more or less toggle switches and/or buttons for controlling sewing modes could be included with the sewing machine.

In one embodiment, the sewing machine does not include buttons 75 for a control interface 70, and it instead includes a plurality of switches, knobs, or other foreseeable control interfaces which perform substantially similarly to the buttons 75 described herein above. In this embodiment, the switches, knobs, or other foreseeable control interfaces may also be positioned at any location associated with the sewing machine as long as they are within reach of a user.

Presently, sewing machines such as those described in the present application may include tablet devices, or tablets for use therewith. In the present embodiment, a Samsung Galaxy Tab 3 10.1 Android may be used with the sewing machine. Tablets are used with sewing machines to control a sewing machine by positioning needles, operating the laser used when tracing pantograph patterns, starting and stopping sewing, and many other functions.

In an alternative embodiment, the tablet may be used to control the stitching modes and speeds in the manner above in place of buttons 75 or other control interfaces 70. In this embodiment, it should be noted that the user may command a sewing machine to switch modes immediately upon direction, as previously described. Thus the modes may be switched while the machine is in operation or stopped. It should further be noted that in this embodiment, the modes which may be available to a user may be pre-set by a user. The user may define these pre-set modes using software of the application the tablet uses in operating the sewing machine.

Figure 3:
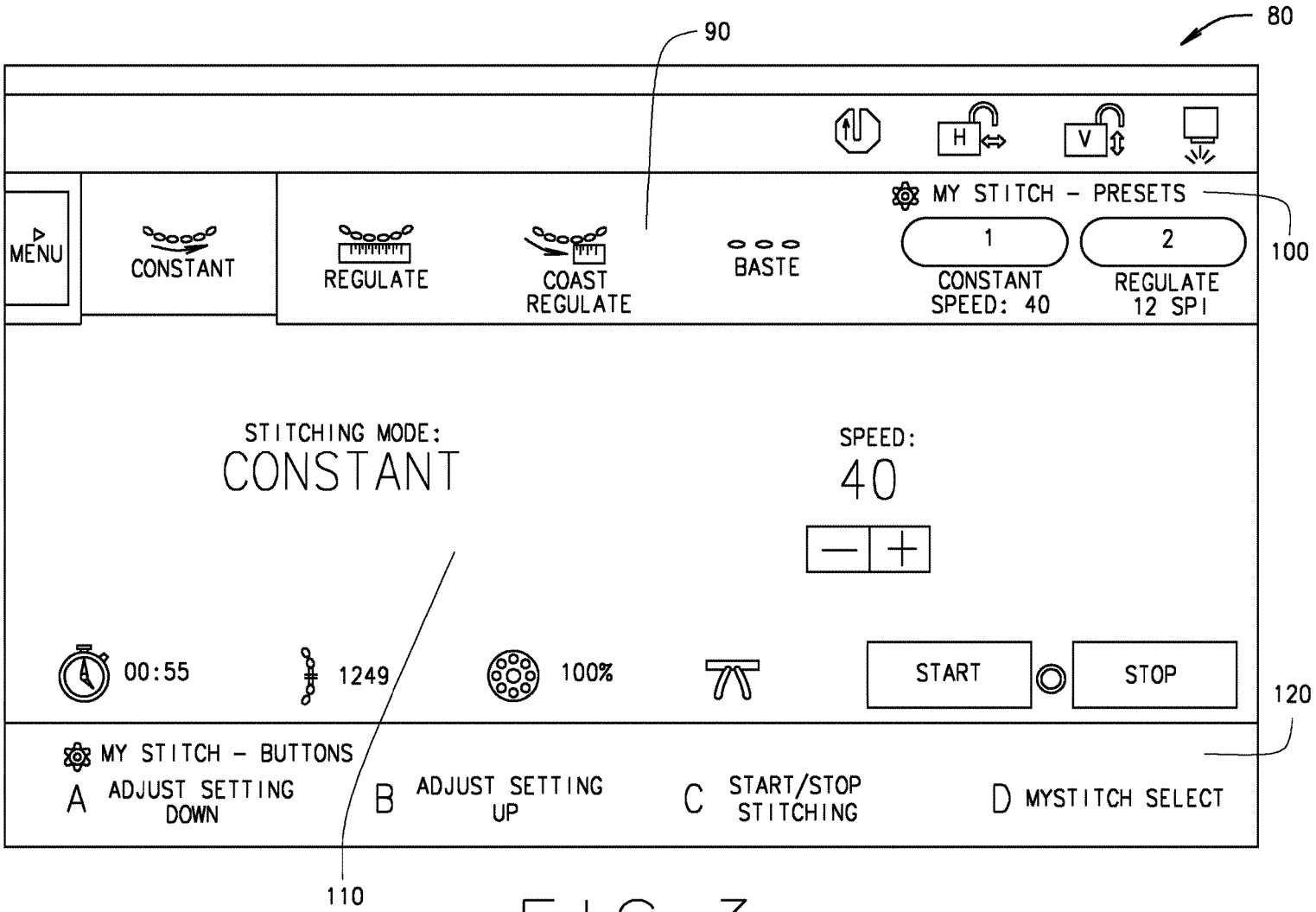
FIG. 3 is a screenshot of a user interface associated with and for controlling various settings of a sewing machine.

FIG. 3 is a user interface 80 of the tablet 5 as an operator may see it. In the illustrated embodiment, user interface 80 includes a top ribbon 90, where a variety of modes may be selected to automatically switch the mode in which the machine is operating, including user preset modes 100. User preset modes 100 may be programmed by the user via software associated with the tablet or in other manners known throughout the art. In the illustrated embodiment, there are two user preset modes 100 displayed, though alternative embodiments including more user preset modes 100 are foreseen.

The screenshot further includes a mode section 110 where the mode in which the sewing machine is operating is displayed. A bottom ribbon 120 is also illustrated in FIG. 3. Bottom ribbon 120 allows a user to assign various button 75 functions. In FIG. 3, the functions assigned to buttons 75 are (A)—ADJUST SETTING DOWN, (B)—ADJUST SETTING UP, (C)—START/STOP STITCHING, and (D)—MYSTITCH SELECT. In the illustrated embodiment, MYSTITCH SELECT mode is preset mode 100 including speed and stitch regulating, though as set forth above the MYSTITCH SELECT mode is user programmable.

Figure 4:
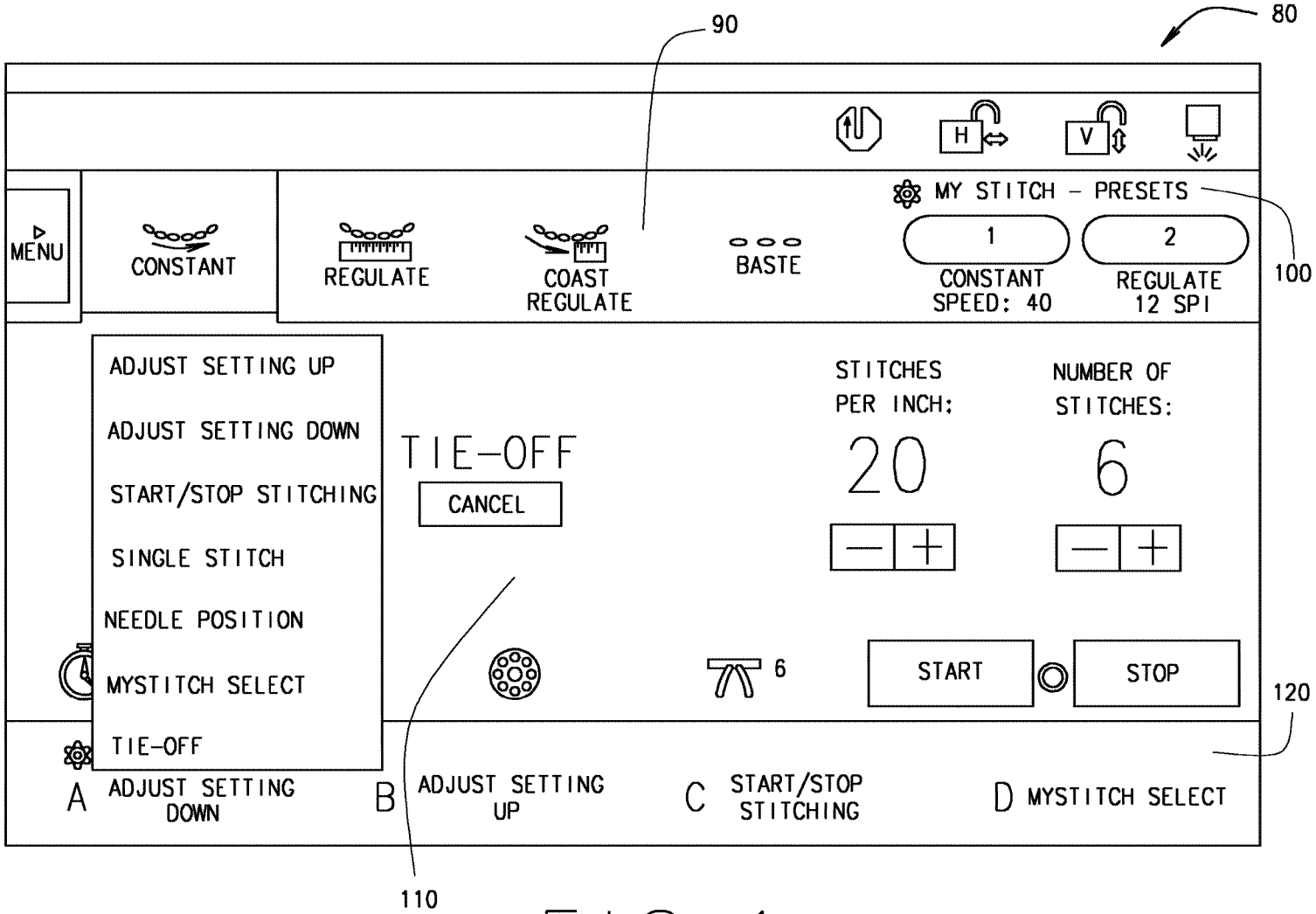
FIG. 4 is a second screenshot of a user interface associated with and for controlling various settings of a sewing machine.

In the preferred embodiment, setting (A) corresponds to one button 75 on one switch 70 shown in FIG. 2, setting (B) corresponds to one button 75 on one switch 70 shown in FIG. 1, setting (C) corresponds to one button 75 on one switch 70 shown in FIG. 1, and setting (D) corresponds to one button 75 on one switch 70 shown in FIG. 2 such that each setting corresponds to a single button 75. In alternative embodiments, there may be more settings from which to choose and/or more control interfaces 70 to carry out those settings. For example, in FIG. 4, menu 130 displays frequently used operations, or settings, that a user may select from in assigning the various button functions via bottom ribbon 120.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A system for regulating the operation of a sewing machine, said system comprising:

a handle assembly for use with said sewing machine;

at least one control interface in communication with said handle assembly for switching modes of said sewing machine; and a user interface in communication with the at least one control interface for programming modes to each of the at least one control interface, wherein said control interface switches modes of said sewing machine when a needle of said sewing machine is in motion during operation of said sewing machine, wherein said modes of said sewing machine include at least one of a Constant mode, a Basting mode, and a Regulated mode.

2. The system of claim 1, wherein the control interface includes at least one switch.

3. The system of claim 2, wherein the at least one switch includes one or more buttons.

4. The system of claim 3, wherein each of the one or more buttons are programmable via the user interface to correspond to a mode of the sewing machine.

5. The system of claim 1, wherein the user interface includes the at least one control interface in communication with the handle assembly.

6. The system of claim 1, wherein the control interface and the user interface are in communication via a wireless connection.

7. The system of claim 1, wherein the control interface is fixedly attached to the handle assembly.

8. The system of claim 1, wherein the control interface and the handle assembly are in communication via a wireless connection.

9. The system of claim 1, wherein the user interface is programmable such that a user may program settings including at least one of stitch speed and stitch mode to the at least one control interface.

10. The system of claim 1, wherein the user interface is a tablet device.

11. A method for switching modes of a sewing machine comprising the steps of:

configuring a plurality of modes for sewing machine operation via a user interface, wherein said plurality of modes for sewing machine operation includes at least one of a Constant mode, a Basting mode, and a Regulated mode;

assigning at least one of said plurality of modes for sewing machine operation to at least one control interface of said sewing machine; and switching said sewing machine from one of said plurality of modes to a second of said plurality of modes when a needle of said sewing machine is in motion during operation of said sewing machine.

12. The method of claim 11, wherein the control interface includes a plurality of switches, and wherein each of the plurality of switches includes a plurality of buttons, each of the plurality of buttons corresponding to a mode for sewing machine operation.

13. A system for regulating the operation of a sewing machine, said system comprising:

a handle assembly for use with said sewing machine;

at least one control interface in communication with said handle assembly for switching modes of said sewing machine; and a user interface in communication with the at least one control interface for programming modes to each of the at least one control interface, wherein said control interface switches modes of said sewing machine when a needle of said sewing machine remains in motion during operation of said sewing machine, wherein said modes do not include a mode to start or stop sewing.

14. The system of claim 13, wherein the control interface includes at least one switch.

15. The system of claim 13, wherein the user interface includes the at least one control interface in communication with the handle assembly.

16. The system of claim 13, wherein the control interface and the user interface are in communication via a wireless connection.

17. The system of claim 13, wherein the control interface is fixedly attached to the handle assembly.

18. The system of claim 13, wherein the control interface and the handle assembly are in communication via a wireless connection.

19. The system of claim 13, wherein the user interface is programmable such that a user may program settings including at least one of stitch speed and stitch mode to the at least one control interface.

20. The system of claim 13, wherein the user interface is a tablet device.

* * * * *